US007165876B2

(12) United States Patent
Dickie

(10) Patent No.: US 7,165,876 B2
(45) Date of Patent: Jan. 23, 2007

(54) ILLUMINATING DEVICE UTILIZING LIGHT-EMITTING DIODE ARRAY

(75) Inventor: Robert G. Dickie, Newmarket (CA)

(73) Assignee: American Tack & Hardware Co., Inc., Saddle River, NJ (US)

( * ) Notice: Subject to any disclaimer, the term of this patent is extended or adjusted under 35 U.S.C. 154(b) by 0 days.

(21) Appl. No.: 11/069,446

(22) Filed: Mar. 1, 2005

(65) Prior Publication Data

US 2006/0198142 A1 Sep. 7, 2006

(51) Int. Cl.
*H01R 33/00* (2006.01)

(52) U.S. Cl. ..... 362/642; 362/251; 362/800; 362/802; 362/276; 315/193; 315/313

(58) Field of Classification Search ..... 362/640–644, 362/646, 295, 800, 802, 251, 276; 315/193, 315/313

See application file for complete search history.

(56) References Cited

U.S. PATENT DOCUMENTS 6,431,719 B1 * 8/2002 Lau et al. ..... 362/641
6,648,496 B1 * 11/2003 Elghoroury et al. ..... 362/295
6,752,515 B2 * 6/2004 Evans et al. ..... 362/800

* cited by examiner

*Primary Examiner*—Stephen F Husar
(74) *Attorney, Agent, or Firm*—Sand & Sebolt

(57) ABSTRACT

A nightlight including a light bank having light-emitting diodes (LEDs) disposed in an array. The amount of light emitted from the light bank can be varied by engaging a switch that selects between a number of electrical pathways. The device includes a photosensitive device such as a light dependent resistor or photo-diode for switching the device on or off under varying ambient light conditions. The photo-diode may be temporarily deactivated in bright ambient light conditions to check and change the settings of the LEDs.

14 Claims, 7 Drawing Sheets

X
24
28
26
12

ILLUMINATING DEVICE UTILIZING LIGHT-EMITTING DIODE ARRAY

BACKGROUND OF THE INVENTION

1. Technical Field

This invention generally relates to lighting devices. More particularly, the invention relates to an illuminating device which includes a LED (light-emitting diode) array. Specifically, the invention relates to a nightlight which includes a light bank having LEDs therein and which has multiple electrical pathways which can be selectively engaged to regulate the amount of light emitted from the light bank.

2. Background Information

Nightlights have been used for some time to provide sufficient light for a person to move around a room during the night without have to turn on an overhead light. A nightlight can provide comfort to young children who may be afraid of total darkness, can provide enough light for a parent to check on an infant or may provide light to negotiate the way to a bathroom without waking up an entire household.

Originally, night lights were provided with a 7 W incandescent light bulb. These night lights provided the necessary light to negotiate around a room, but because the bulbs were incandescent, they tended to generate some heat and tended to burn out fairly easily.

In the last few years, LED (light-emitting diode) technology has advanced to the point that LEDs can be used for low-cost applications such as nightlights. The LEDs can emit various colors of light including white, green and red. The white LEDs tend to be high intensity LED devices which provide a fairly substantial amount of light. This is useful for locations such as bathrooms and staircases, but can be problematic if used in bedrooms because the quantity of light emitted can tend to interfere with some people falling asleep.

There is therefore a need in the art for an illuminating device in which the quantity of light emitted by LEDs can be adjusted.

There is further a need in the art for an illuminating device which can be checked and adjusted during daylight or bright ambient light conditions to determine and vary the settings of the LEDs so that they deliver a specified quantity of light in the dark.

SUMMARY OF THE INVENTION

The illuminating device of the present invention is useful as a nightlight. The device includes a light bank having one or more LEDs (light-emitting diodes), a photosensitive device for switching the device on and off depending on the ambient light conditions surrounding the nightlight and an actuator button for selecting whether one, two or more of the LEDs are powered. The device's electrical circuit may includes a resistor to reduce the power delivered to one or more of the LEDs. The photosensitive device is positioned within or under the actuator button and is selectively coverable. This allows the user to determine how many of the bulbs are switched on or off and whether or not they are in a dimmed or undimmed condition, even when the nightlight is surrounded by a high level of ambient light. The nightlight can therefore put out a high level of light from one, two or more LEDs, or can put out a reduced level of light from one, two or more LEDs.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

FIG. 9 is a schematic representation of the LED array of FIG. 8 showing the LED array with one LED off and two LEDs on;

DETAILED DESCRIPTION OF THE INVENTION

FIGS. 1–12 illustrates the preferred embodiments of a nightlight including a configuration and layout of a light bank including a LED array and electrical circuit relating thereto. It is, however, to be understood that modifications and variations may be made to the illustrated configuration and circuit layout without departing from the general principles of the invention hereinafter described.

Figure 1:
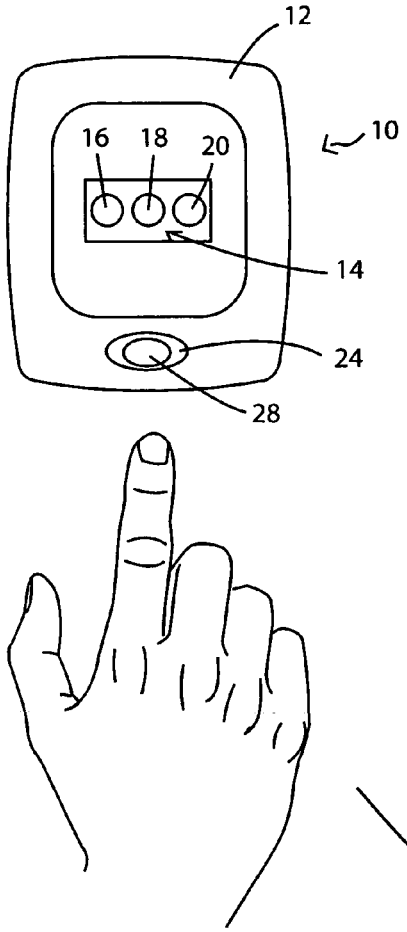
FIG. 1 is a front elevational view of a nightlight in accordance with the present invention.
Figure 2:
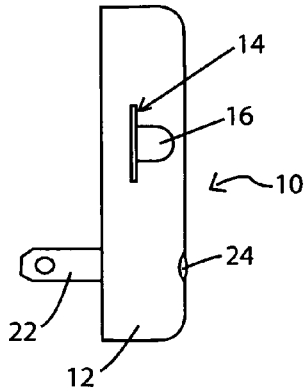
FIG. 2 is a side elevational view of the nightlight through line 2—2 of FIG. 1.
Figure 3:
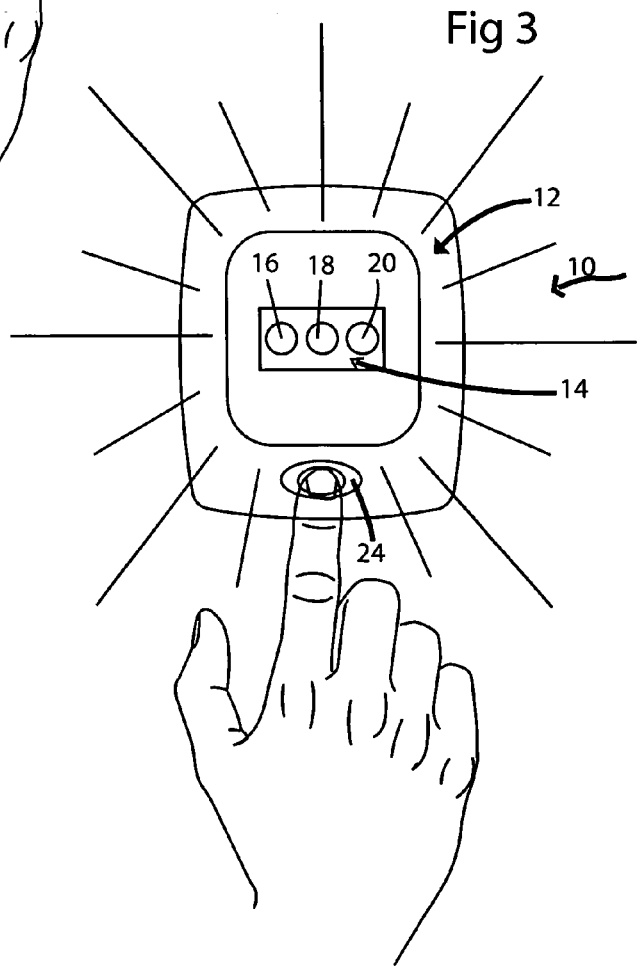
FIG. 3 is a front elevational view of the nightlight of FIG. 1 when activated.

Referring to FIGS. 1–3, there is shown a nightlight in accordance with the present invention and generally indicated at 10. Nightlight 10 comprises a housing 12 having a including a light bank 14 which includes one or more LEDs 16, 18 and 20. LEDs 16, 18 and 20 preferably are medium intensity white LEDs, but if a single LED is used, it preferably is a very high intensity white bulb. LEDs 16, 18, 20 may be arranged in light bank 14 in any desired manner such as a row, circle or triangle. Nightlight 10 preferably is connected to alternating current and the housing 12 is therefore provided with electrical prongs 22 to connect device 10 to an electrical outlet (not shown).

Figure 4:
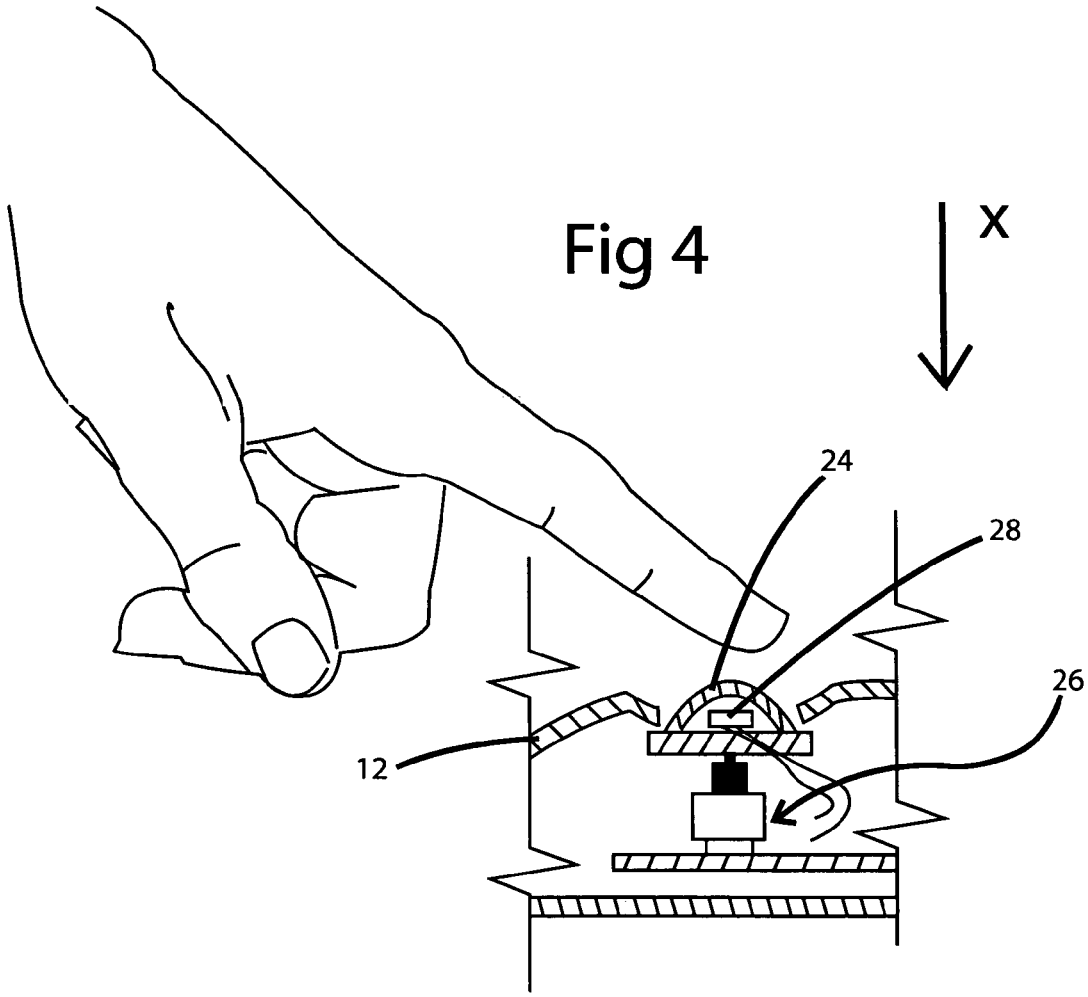
FIG. 4 is a partial cross-sectional side view showing the actuating switch and photosensitive device disposed in the housing.

Referring to FIG. 4, LEDs 16, 18, 20 are connected to a switch 26 which is activated by depressing a button 24 on housing 12. Switch 26 may be connected to a resistor (not shown in this figure) to reduce current to LEDs 16,18 and 20. Alternatively switch 26 may be connected into the circuit in such a manner as to selectively switch one or two of the LEDs into or out of the circuit so that the light emitted from device 10 is dimmed or brightened by the number of bulbs illuminated.

Nightlight 10 is switched on or off by way of a photosensitive device 28 disposed at one of within or behind button 24. Button 24 is made from a transparent material which allows light from the environment surround device 10 to be received by the photosensitive device 28. In bright ambient light, the photosensitive device 28 substantially prevents current from flowing through LEDs 16, 18 and 20 and thereby turns LEDs 16, 18 and 20 off. In low ambient light conditions the photosensitive device 28 allows current to flow through LEDs 16, 18, and 20 and thereby turns the LEDs on. Button 24 preferably is recessed in housing (FIG. 2) so that light emitted from LEDs 16, 18, 20 does not deactivate the photosensitive device 28 which would in turn switch LEDs 16,18 and 20 off. It will be understood by those skilled in the art that any suitable photosensitive device 28 may be utilized in circuit 30 to switch LEDs 16, 18, 20 on or off. Such photosensitive devices include light dependent resistors (LDR's) and photo-diodes. The remainder of this specification will make reference to photo-diodes, but it is to be understood that the description applies equally to LDR's or other photosensitive devices.

Figure 5:
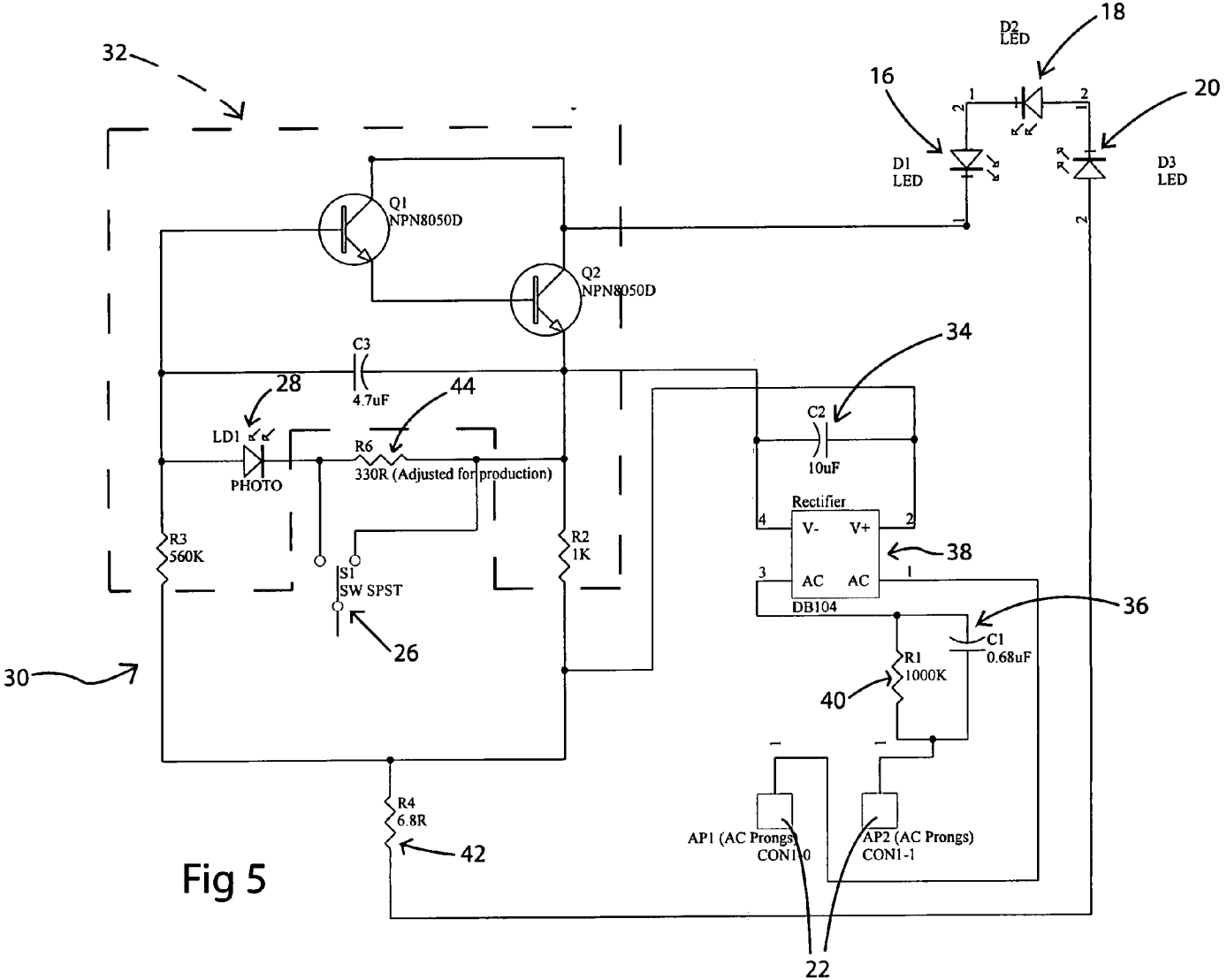
FIG. 5 is a circuit diagram for a first embodiment of the nightlight.
Figure 6:
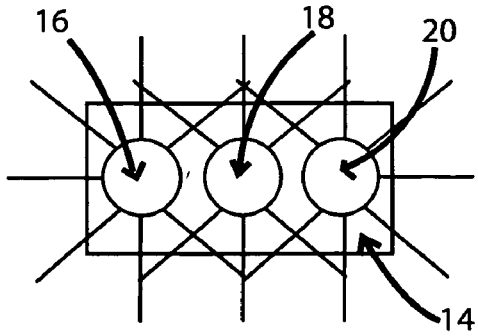
FIG. 6 is a schematic representation of the light bank LED array of FIG. 5 showing the LED array with all three LEDs on and emitting maximum light.
Figure 7:
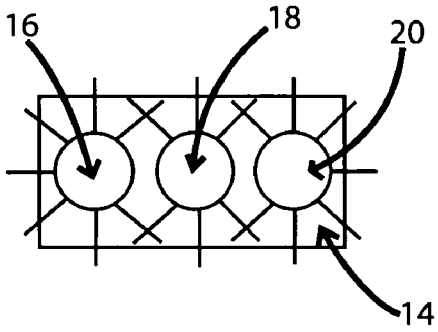
FIG. 7 is a schematic representation of the LED array of FIG. 5 showing the LED array with all three LEDs on and emitting dimmed light.

Referring to FIGS. 5–7, there is shown an electrical circuit 30 for a first embodiment of nightlight 10 in accordance with the present invention. Circuit 30 includes three LEDs 16, 18, 20 connected in series with an AC source (not shown) via prongs 22. It will be understood that circuit 30 could, however, include only one LED or could include more than three LEDs without departing from the spirit of the present invention. Circuit 30 includes a photo-diode circuit, well known in the art and identified by box 32. Circuit 30 further includes capacitors 34, 36, a rectifier 38 to change alternating current from the power source to direct current, and resistors 40 and 42. Switch 26 is provided to selectively route current through a resistor 44. When switch 26 is open, current does not flow through resistor 44 and consequently the maximum amount of current flows through LEDs 16, 18, 20 and the maximum possible amount of light is emitted by LEDs 16, 18 and 20. This situation is illustrated in FIG. 6, where the amount of light emitted from light bank 14 is shown by long lines radiating outwardly from LEDs 16, 18 and 20. When switch 26 is closed, current flows through resistor 44 reducing the voltage received by all three LEDs 16, 18, 20, resulting in less light being emitted by device 10. This situation is illustrated by FIG. 7, where the amount of light emitted from light bank 14 is shown by short lines radiating outwardly from LEDs 16, 18 and 20. Should brighter light be required from device 10, switch 26 can be opened again to prevent current from flowing through resistor 44.

Figure 9:
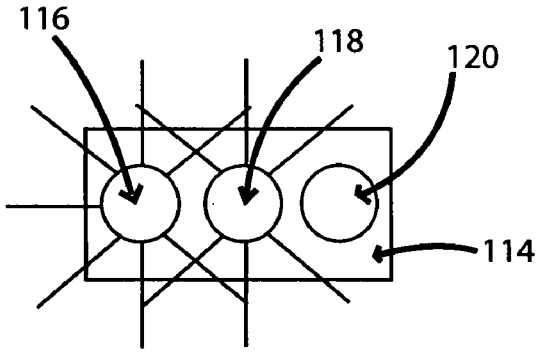
Figure 8:
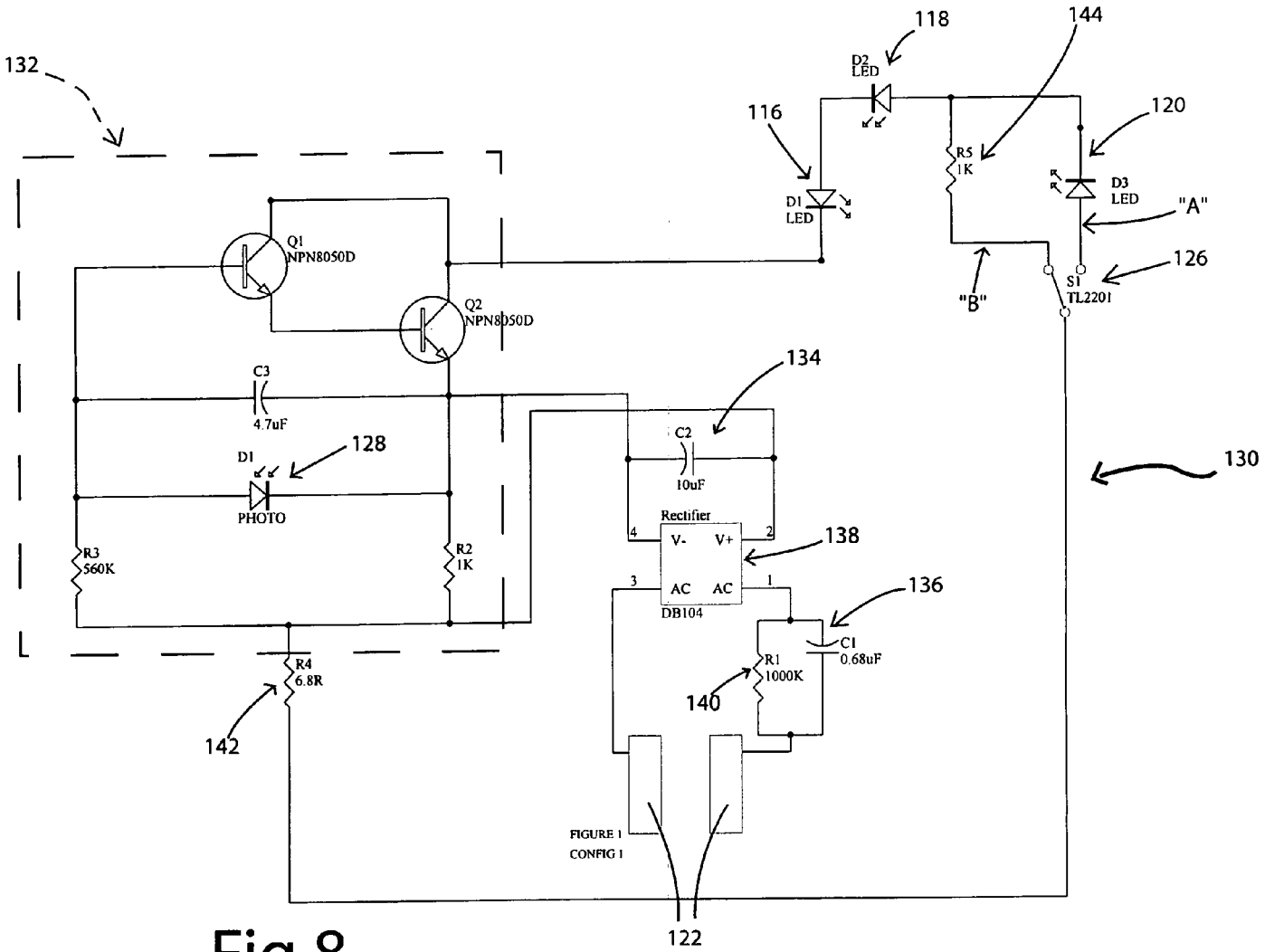
FIG. 8 is a circuit diagram of a second embodiment nightlight.

Referring to FIGS. 8–9 there is shown an electrical circuit for a second embodiment of nightlight in accordance with the present invention and referenced by the number 130. In circuit 130, LEDs 116, 118 and 120 are connected in series with an AC power source (not shown) via prongs 122; and to a well-known photo-diode circuit represented by box 132. Circuit 130 includes two capacitors 134 and 136; a rectifier 138 and biasing resistors 140, 142 and 144. Switch 126 is connected into circuit 130 so that when switch 126 is activated, current can be routed through either all three LEDs 116, 118 and 120 or one of the LEDs, namely 120, can be cut out of circuit 130. When switch 126 is in a first position, current flows through the pathway represented by "A"(FIG. 8) and all three LEDs 116, 118 and 120 are on. When switch 126 is in a second position, current flows through the pathway represented by "B" and through resistor 144. In this second instance, only LEDs 116 and 118 are illuminated. As a consequence, the light emitted by nightlight 10 is dimmer than when all three LEDs 116, 118, 120 are emitting light. The nightlight is therefore effectively dimmed. This second situation is illustrated by the array 114 shown in FIG. 9 where only LEDs 116 and 118 are shown emitting light. If the user wishes to increase the amount of illumination from device 10, switch 126 is depressed again to reroute current through all three LEDs 116, 118 and 120.

Figure 11:
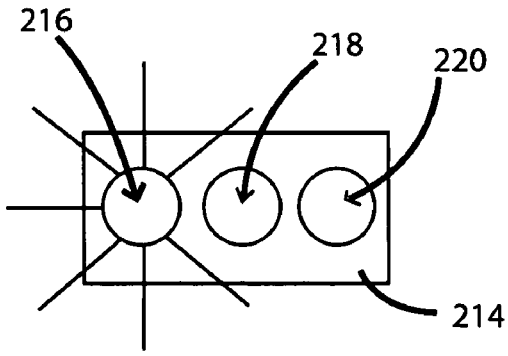
FIG. 11 is a schematic representation of the LED array of FIG. 10 showing only one of the LEDs in the on position.
Figure 10:
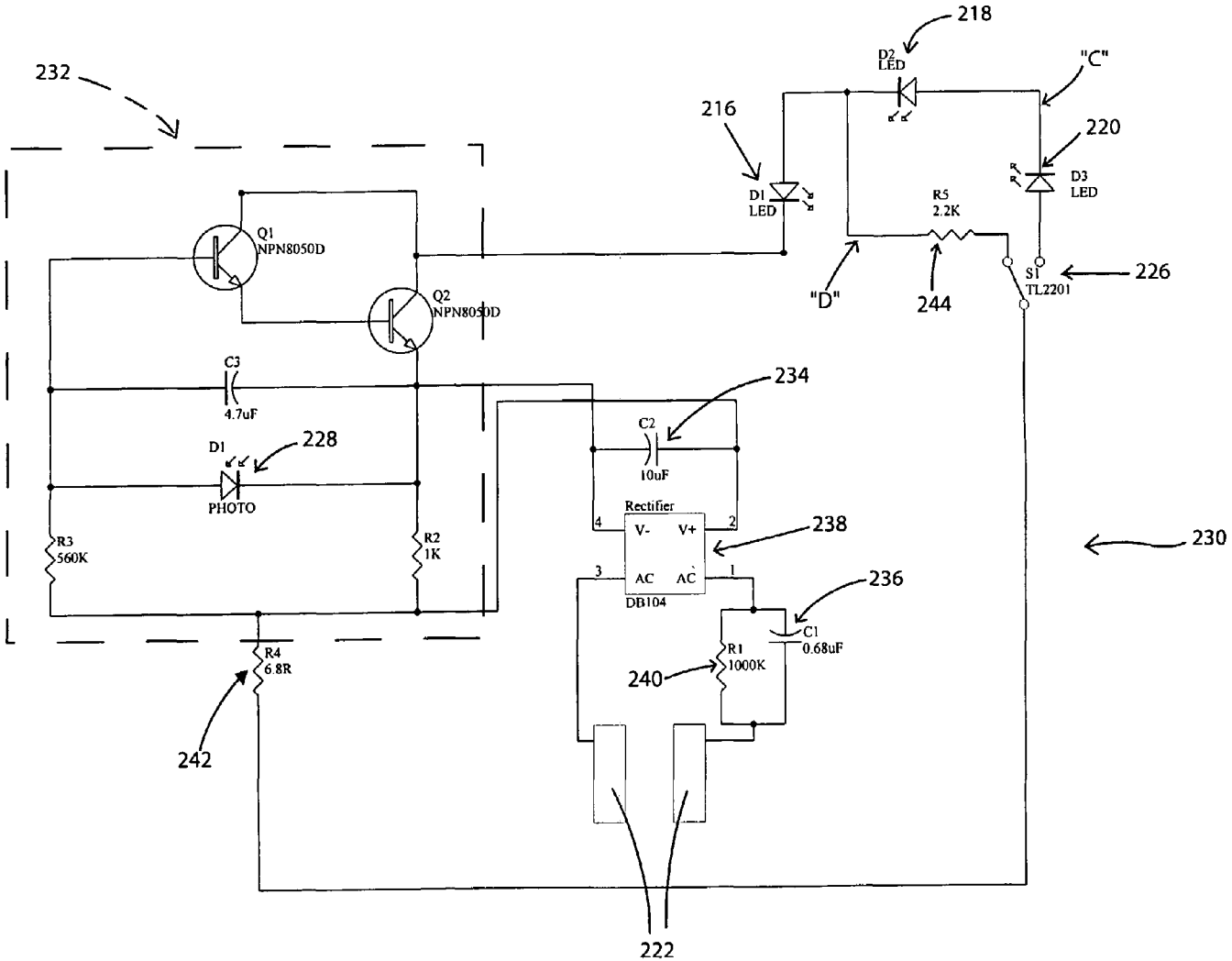
FIG. 10 is a circuit diagram of a third embodiment of nightlight.

Referring to FIGS. 10–11 there is shown an electrical circuit for a third embodiment of nightlight in accordance with the present invention and referenced by the number 230. In circuit 230, LEDs 216, 218 and 220 are connected in series with an AC power source (not shown) via prongs 222; and to a well-known photo-diode circuit represented by box 232. Circuit 230 includes two capacitors 234 and 236; a rectifier 238 and biasing resistors 240, 242 and 244. A two-way switch 226 is provided to selectively route current through all three LEDs 216, 218 and 220; or through only one of the LEDs, namely bulb 216. When switch 226 is in a first position, current flows through the pathway represented by "C" (FIG. 10) and all three LEDs 216, 218 and 220 are illuminated. When switch 226 is in a second position, current flows through the pathway represented by "D" and through resistor 244. In this second instance, only LED 216 is illuminated. As a consequence, the light emitted by nightlight is substantially dimmer than when all three LEDs 216, 218, 220 are emitting light. The nightlight is therefore effectively dimmed. This second position of switch 226 is illustrated by the array 214 shown in FIG. 11 where only LED 216 is shown emitting light. Should the user wish to have the device 10 emit more light, switch 226 is depressed so that current flows once again down pathway "C" and through all three LEDs 216, 218 and 220.

Figure 12:
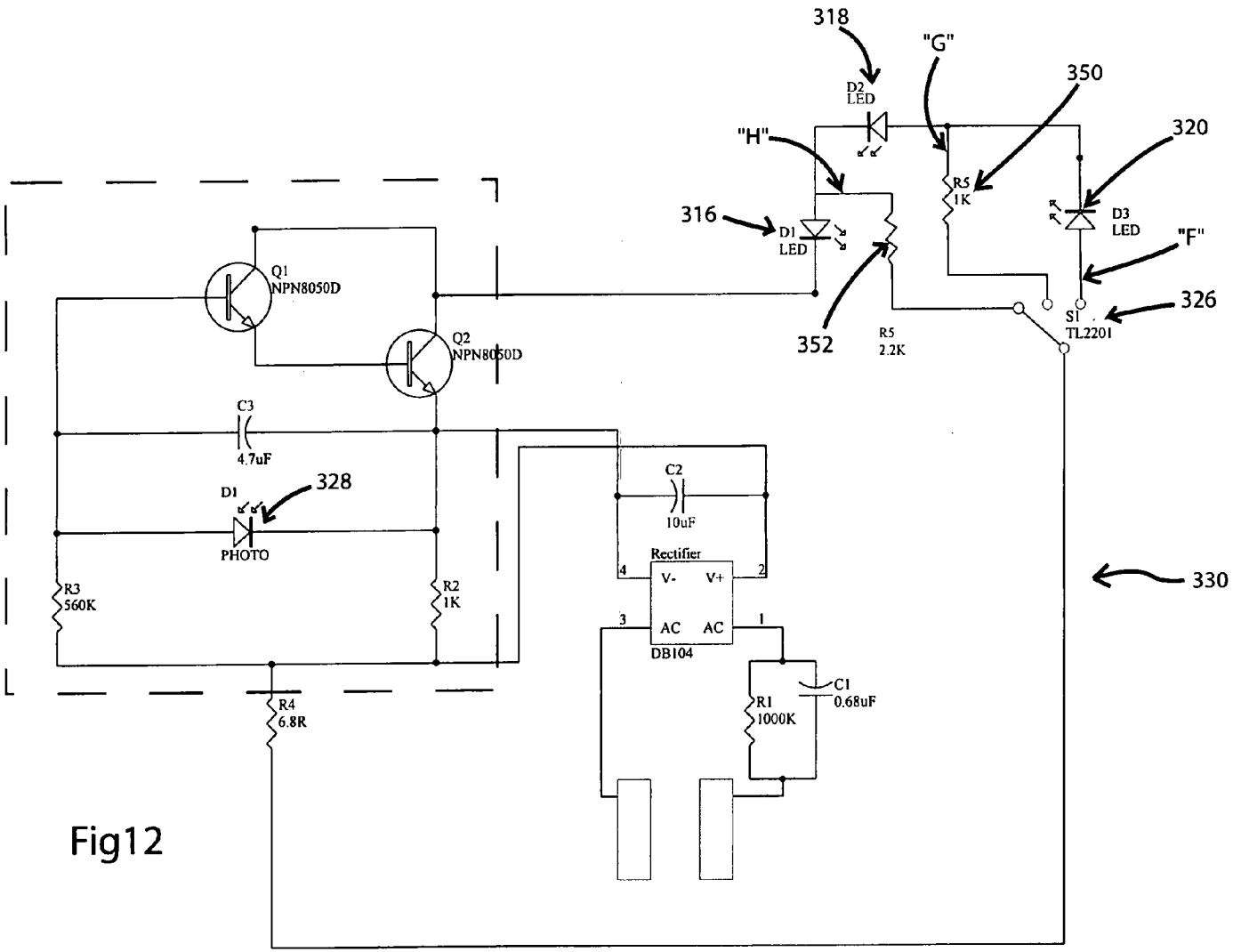
FIG. 12 is a circuit diagram of a fourth embodiment of nightlight.

Referring to FIG. 12 there is shown an electrical circuit for a fourth embodiment of nightlight in accordance with the present invention and referenced by the number 330. Circuit 330 includes all components shown in either of the second and third embodiments of nightlight, but the switch 326 is a three-way switch and circuit 330 includes two biasing resistors 344 and 346. Switch 326 allows for pathways "F", "G" or "H" to be selected. When pathway "F" is selected, all three LEDs 316, 318 and 320 are on. When pathway "G" is selected, only LEDs 316 and 318 are on. When pathway "H" is selected, only LED 316 is on. It is therefore possible for a user to select a graduated dimming or brightening of the nightlight depending on how much light they wish the device to emit.

It will be understood by those skilled in the art that a switch and associated resistor may be incorporated into any of the second, third or fourth embodiments of the present invention without departing from the scope of the present invention.

With reference to the first embodiment of the invention, nightlight 10 is used in the following manner. Device 10 is plugged into an AC power outlet by way of electrical prongs 22. Photo-diode 28 senses the ambient light conditions surrounding device 10 by receiving light through button 24. If the ambient light conditions are bright, circuit 30 is broken and none of the LEDs 16,18 and 20 light up. If photo-diode 28 senses low ambient light conditions surrounding device 10, photo-diode 28 closes the circuit 30 and all three LEDs 16,18 and 20 light up. If the user wishes to dim device 10, they engage switch 26. This causes current to flow through resistor 44 and all three LEDs 16,18 and 20 are dimmed. If the user wishes more light to be emitted from device 10, they depress button 24 again so that switch 26 opens and current no longer flows through resistor 44. All three LEDs 16, 18 and 20 therefore emit the maximum possible amount of light. Because photo-diode 28 is positioned inside clear button 24, if the user places their finger over button 24, photo-diode 28 automatically senses low ambient light conditions and LEDs 16,18 and 20 light up. The user can then see, even in bright ambient light conditions, whether LEDs 16,18, and 20 are in a dimmed or undimmed condition.

In the second, third and fourth embodiments, the activation switch 126, 226 or 236 respectively, can be used to select how many LEDs are included in the circuit and therefore how bright or dim the light emitted from the device is. This selection is made by depressing the button 24 on the housing 12 until the appropriate number of LEDs are illuminated. As with the first embodiment of the invention, the number of bulbs illuminated can be checked even in bright ambient light conditions by the user simply placing their finger over the button 24 to substantially prevent any light from reaching the photo-diode 128, 228 and 328, respectively. When the photo-diode is covered, the circuit is closed and the activated LEDs included in the circuit light up. The user can change the amount of light emitted by the nightlight by depress the button 24 until the desired number of LEDs are emitting light. When the user removes their fingertip from button 24, the photo-diode switches the nightlight off. In low ambient light conditions, the activated LEDs can be easily observed. The number of activated LEDs can be changed by depressing button 24 until the desired number are lighted. In this manner, the user can select the brightness or dimness of the nightlight in both bright and low ambient light conditions.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A nightlight comprising:

a housing;

a light bank mounted on the housing; said light bank including;

a first light emitting diode (LED);

an electrical circuit adapted to connect the light bank to a power source; whereby the light bank emits light when connected to the power source;

a first pathway in the electrical circuit to allow a first amount of light to be emitted from the light bank;

a second pathway in the electrical circuit to allow a second amount of light to be emitted from the light bank; wherein the first amount of light is greater than the second amount of light;

a switch for selectively moving between the first and second pathways, a resistor included in the second pathway, wherein the switch is movable between a second position where the resistor is connected into the electrical circuit by way of the second pathway; and a first position where the resistor is excluded from the electrical circuit by way of the first pathway;

a transparent button mounted on the housing and wherein the switch is activated by depressing the button; and a photosensitive device mounted at one of within and behind the transparent button; and wherein the photosensitive device allows current to flow through the light bank in low ambient light conditions; and prevents current from flowing through the light bank in bright ambient light conditions.

2. The nightlight as defined in claim 1, wherein the button is recessed within the housing.

3. The nightlight as defined in claim 2, wherein the button is selectively coverable to deactivate the photosensitive device during bright ambient light conditions.

4. The nightlight as defined in claim 2, wherein the photosensitive device is selected from a group consisting of a photo-diode and a light dependent resistor.

5. The nightlight as defined in claim 4, further comprising at least a second LED connected with the first LED.

6. The nightlight as defined in claim 5, wherein the first and second LEDs are connected in series.

7. The nightlight as defined in claim 1, further comprising at least a second LED carried in the light bank; and in which the first pathway includes all of the LEDs and the second pathway includes less than all of the LEDS.

8. The nightlight as defined in claim 7, wherein the LEDs are connected in series.

9. The nightlight as defined in claim 7, further comprising:

a three-way switch; and a third electrical pathway in the electrical circuit to allow a third amount of light to emit from the light bank; wherein the third amount of light is less than the first and second amounts of light.

10. The nightlight comprising:

a housing;

a light bank mounted on the housing and comprising;

a first light emitting diode (LED);

at least a second LED carried in the light bank;

an electrical circuit adapted to selectively connect the light bank to a power source;

a first pathway in the electrical circuit to allow a first amount of light to be emitted from the light bank;

a second pathway in the electrical circuit to allow a second amount of light to be emitted from the light bank; and wherein the first amount of light is more than the second amount of light; and wherein the first pathway includes all of the LEDs and the second pathway includes less than all of the LEDS;

a switch for selectively moving between the first and second pathways;

a transparent button mounted on the housing; and wherein the switch is activated by depressing the transparent button; and a photosensitive device mounted at one of within and behind the transparent button for allowing current to flow through the LEDs in low ambient light conditions and for preventing current from flowing through the LEDs in bright ambient light conditions.

11. The nightlight as defined in claim 10, wherein the button is selectively coverable in bright ambient light conditions and the photosensitive device is thereby activated to allow current to flow through the LEDs.

12. The nightlight as defined in claim 11, wherein the transparent button is recessed within the housing.

13. A method of checking and setting the intensity of light emitted from a night light comprising the steps of:

providing a nightlight having a housing including a light bank having one or more light emitting diodes; an electrical circuit adapted to connect the light bank to a power source; whereby the light bank emits light when connected to the power source; a photo-sensitive device connected into the electrical circuit to switch the nightlight on and off; the photosensitive device being mounted within or behind a transparent button mounted on the housing; a first pathway in the electrical circuit to allow a first amount of light to emit from the light bank; a second pathway in the electrical circuit to allow a second amount of light to emit from the light bank;

wherein the first amount of light is more than the second amount of light; and a switch for selectively moving between the first and second pathways;

placing a fingertip over the actuator button in high ambient light conditions to prevent ambient light from being sensed by the photosensitive device;

viewing the light bank to determine how many LEDs are activated and to determine whether the activated LEDs are emitting a first or second amount of light.

14. The method as defined in claim 13, wherein the switch is activated via the button; and the method further comprises the steps of:

depressing the button to select between the first and second pathways in the electrical circuit.

* * * * *